US006301949B1

(12) United States Patent
Beddoe et al.

(10) Patent No.: US 6,301,949 B1
(45) Date of Patent: Oct. 16, 2001

(54) PRESS FOR FORMING WORKPIECES

(75) Inventors: Andrew Gregory Beddoe, Bozeman, MT (US); Ezra Lark Merrill, Albuquerque, NM (US); Trent Robert Wetherbee, Kennewick; Thomas Jacob Hagman, Seattle, both of WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/536,326

(22) Filed: Mar. 24, 2000

(51) Int. Cl.[7] ..... B21J 13/10

(52) U.S. Cl. ..... 72/420; 72/389.3; 72/426; 72/427; 83/157; 100/218

(58) Field of Search ..... 72/418, 419, 420, 72/421, 389.1, 389.3, 389.6, 453.01, 455, 456, 426, 427; 192/130, 132, 133, 134, 135; 100/53, 218; 83/82, 157, 165

(56) References Cited

U.S. PATENT DOCUMENTS

| | | | | |
|---|---|---|---|---|
| 3,349,602 | * | 10/1967 | Nelson | 72/426 |
| 3,514,991 | * | 6/1970 | Merrill et al. | 72/420 |
| 3,653,293 | * | 4/1972 | Wallis | 72/426 |
| 3,832,881 | * | 9/1974 | Hemler et al. | 72/420 |
| 4,114,418 | * | 9/1978 | Jarman | 72/421 |
| 4,242,900 | * | 1/1981 | Dixon | 72/427 |
| 4,292,892 | * | 10/1981 | Combs | 72/421 |
| 4,457,684 | * | 7/1984 | Gran | 72/455 |
| 4,753,100 | * | 6/1988 | Hanni | 72/419 |
| 4,961,337 | * | 10/1990 | Henning et al. | 72/426 |
| 6,138,542 | * | 10/2000 | Overgaard | 83/165 |

* cited by examiner

*Primary Examiner*—Ed Tolan
(74) *Attorney, Agent, or Firm*—Alston & Bird LLP

(57) ABSTRACT

A reciprocating press for forming workpieces includes a tilting table that supports the workpiece and positions it with respect to the press tooling as the press closes, and then is pivoted upward into an inclined orientation as the press opens so that the finished workpiece falls down the table and is automatically discharged from the press. A preferred embodiment has a lifting arm attached to an upper reciprocating press member that carries an upper forming tool such as a punch. The lower end of the lifting arm engages the tilting table such that the table is pivoted about a horizontal axis in concert with the upward and downward movement of the reciprocating press member. The press preferably also includes a safety door that is automatically closed before the press fully closes and is opened again as the press opens such that operator access to the moving press parts is prevented by the door during a press cycle. The safety door is powered by a system employing a pair of pneumatic cylinders between which air is pumped in response to the opening and closing of the press. The press also includes stroke-adjusting variable-length collars mounted on die posts, and one or more shims secured to the reciprocating press member, for varying a stroke distance of the press.

20 Claims, 8 Drawing Sheets

PRESS FOR FORMING WORKPIECES

FIELD OF THE INVENTION

The invention relates to presses for forming workpieces. The invention relates more particularly to a forming press useful for bending sheet metal workpieces, and suitable for use in a single-part-flow manufacturing line such as a Chaku Chaku type of manufacturing line.

BACKGROUND OF THE INVENTION

Traditional batch style of manufacturing calls for large batches of workpieces to be processed at each of a plurality of work stations. At each work station, a large batch of workpieces is processed, and when all of the workpieces in the batch are completed, the batch is transported to the next work station, where a different work operation is performed on each of the workpieces in the batch, and so on, until the batch has moved through all of the work stations on the manufacturing line. Efficiency and productivity studies have shown that in some applications this batch style of manufacturing is inefficient, and that significant improvements in efficiency and productivity can be attained by instead using a single-part-flow style of manufacturing.

In the single-part-flow manufacturing line, a number of work stations are arranged in close proximity to each other so that an operator can easily access each work station with minimal walking or movement required to get from one work station to the next. For example, a number of different machines can be arranged in a U-shaped cell with the operator in the middle. One such manufacturing method is sometimes referred to as a Chaku Chaku type of process. "Chaku Chaku" is a Japanese terms that means "load load." In a Chaku Chaku line, the machines are typically designed such that the operator can load a workpiece into a machine and turn the machine on so that the machine begins its process, and the machine will automatically complete its process without further intervention of the operator. The operator picks up the completed workpiece processed by a given machine, loads a new workpiece into that machine, and starts the machine. The operator then takes the completed workpiece, loads it into the next machine in the line, picks up the previously completed workpiece from that machine, and starts the machine. The process continues down the line. Thus, a given workpiece flows from machine to machine in a very synchronized manner, and does not have to traverse a great distance during the process.

To facilitate this Chaku Chaku style of manufacturing, it should be apparent that it is desirable for a given machine in the line to be automatically operable to as great an extent as possible. It should be relatively easy for the operator to remove a completed workpiece from the machine and to load a new workpiece into the machine. The loading and removal process are performed manually by the operator in many such machines, thus requiring the operator to place his or her hands near moving parts of the machine. Thus, while accessibility to the machine by the operator is essential, safety must also be a key consideration in the design of the machine. Conventional brake presses used for bending sheet metal often require the operator to place his or her hands near the moving press tooling during press operation, thereby compromising safety.

SUMMARY OF THE INVENTION

The present invention was developed for use in a single-part-flow environment for forming metal workpieces such as sheet metal parts, and particularly for three-point bending of sheet metal blanks. The invention provides a press having features enabling a workpiece to be held and positioned properly with respect to the tooling without any assistance by the operator once the workpiece is loaded into the press, and enabling a completed workpiece to be automatically discharged from the press following the completion of a machine cycle. Preferred embodiments of the press also include safety features ensuring that the area near the moving tooling cannot be accessed by the operator during a machine cycle.

To these ends, a press in accordance with a preferred embodiment of the invention includes a press frame, a stationary press member mounted to the frame and supporting a lower forming tool, and a reciprocating press member movably supported by the frame above the stationary press member so as to be movable toward and away from the stationary press member. The reciprocating press member supports an upper forming tool positioned such that the upper and lower tools engage the workpiece therebetween and deform the workpiece when the reciprocating press member is lowered to the bottom of its stroke. The press also includes a drive system for causing the reciprocating press member to execute a stroke, and a tilting table disposed between the stationary and reciprocating press members. The tilting table has a generally planar support surface adapted to support the workpiece thereon. The tilting table is linked to the reciprocating press member such that it pivots during a stroke of the reciprocating press member, starting out in an inclined position when the reciprocating press member is at the top of its stroke, but pivoting into a horizontal position just before the reciprocating press member reaches the bottom of its stroke and the upper forming tool engages the workpiece. When the reciprocating press member returns to the top of its stroke, the tilting table is pivoted back upward such that the support surface becomes inclined and the finished workpiece is carried by gravity downward along the support surface and is automatically discharged from the press. A bin may be provided for catching the discharged workpiece. Preferably, the tilting table includes a fixture jig for positioning a workpiece on the support surface so that the workpiece is in the proper location relative to the forming tools. The fixture jig can comprise a stop member positioned on the tilting table so that gravity urges the workpiece down the inclined support surface of the tilting table and against the stop member. Advantageously, a spring device can be provided on the tilting table for urging the workpiece against the stop member of the fixture jig if gravity alone is not sufficient to ensure that the workpiece remains against the stop member until the forming tools engage the workpiece.

In accordance with a preferred embodiment of the invention, the tilting table defines an aperture therethrough over which the workpiece is positioned. The tilting table is disposed such that when it is pivoted down into the horizontal position, the tilting table surrounds the lower forming tool and the upper forming tool passes through the aperture to engage the workpiece between the forming tools. A flexible diaphragm preferably spans the aperture. The diaphragm protects the workpiece against marring or marking by the lower forming tool, and prevents the workpiece from falling through or becoming lodged in the aperture and thus facilitates the automatic discharging of the workpiece from the press.

The tilting table is linked to the reciprocating press member by a lifting linkage affixed to the reciprocating press member and extending downward therefrom. The linkage engages and lifts one end of the tilting table when the reciprocating press member moves upward toward the top of its stroke. Advantageously, the lifting linkage includes a roller at a lower end thereof, the roller engaging a lower surface of the tilting table. The tilting table preferably is arranged to pivot downward during the downward stroke of the reciprocating press member until the tilting table abuts a hard stop that stops the handler in a horizontal position. The press preferably is configured so that the tilting table reaches the horizontal position a short time before the reciprocating press member reaches the bottom of its stroke; as the reciprocating press member continues toward the bottom of its stroke, the roller of the lifting linkage disengages from the tilting table. The roller re-engages the tilting table as the reciprocating press member starts back up toward the top of its stroke and lifts the tilting table back to the inclined position for discharging the finished workpiece.

In another preferred embodiment of the invention, the press includes a safety door movable between an open position allowing operator access through the front side of the press to the lower forming tool and a closed position preventing such access. The door is closed prior to the forming tools coming together to deform a workpiece, and is opened again after the workpiece is deformed and the reciprocating press member returns to the top of its stroke. The press includes an actuator system for automatically moving the safety door to the closed position prior to the upper forming tool being lowered into engagement with the lower forming tool. The actuator system includes a fluid supply device linked to the reciprocating press member such that downward movement of the reciprocating press member forces fluid under pressure from the fluid supply device, and a fluid-powered actuator connected to the safety door and fluidly coupled to the fluid supply device such that the fluid forced from the fluid supply device activates the actuator to close the safety door. When the reciprocating press member moves back upward, the fluid supply device forces fluid into an opposite side of the actuator so that the actuator opens the safety door. The fluid supply device and actuator advantageously can comprise pneumatic cylinders coupled together in a circuit arrangement.

The invention thus provides a unique press having features providing automated workpiece positioning and discharging of finished parts so that the operator does not have to place his or her hands near the moving parts of the press during a cycle, thereby enhancing part flow and safety. Additionally, where the press includes the automatic safety door feature, safety is further enhanced. Presses made in accordance with the present invention are especially suitable for a single-part-flow or Chaku Chaku style of manufacturing line.

BRIEF DESCRIPTION OF THE DRAWINGS

The above and other objects, features, and advantages of the invention will become more apparent from the following description of certain preferred embodiments thereof when taken in conjunction with the accompanying drawings in which.

DETAILED DESCRIPTION OF THE DRAWINGS

Figure 1:
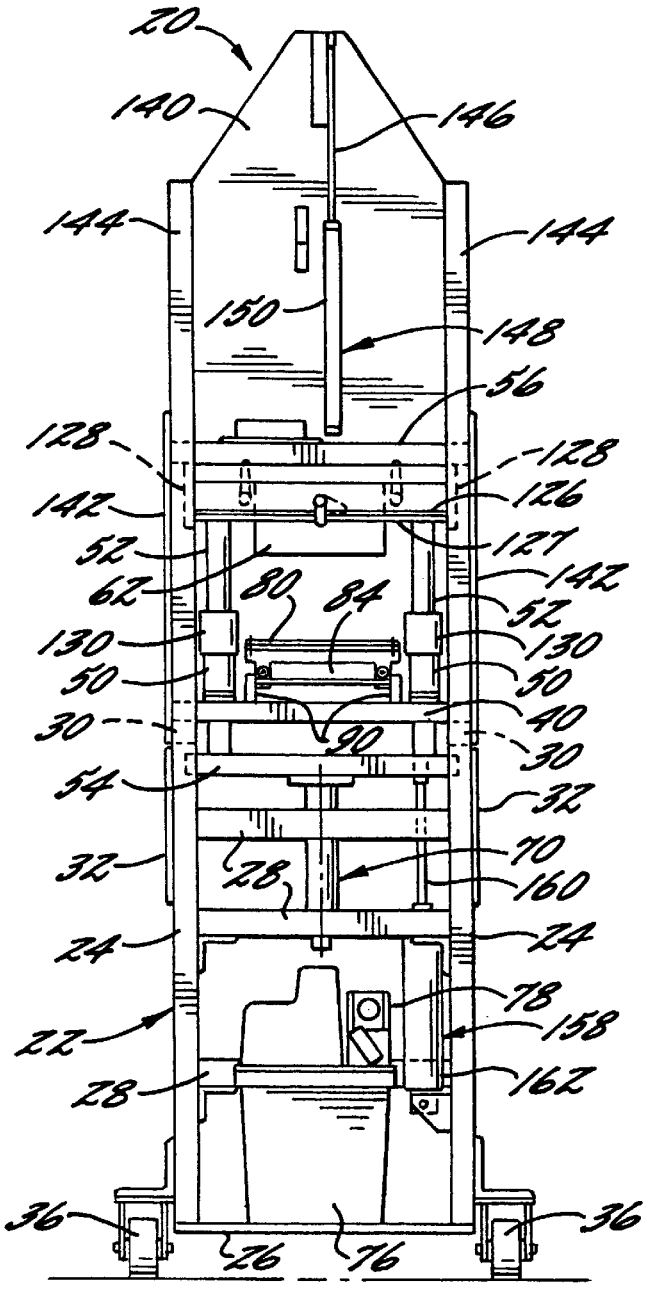
FIG. 1 is a front elevation of a press in accordance with a preferred embodiment of the invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

With reference to FIGS. 1 through 5, a forming press in accordance with a preferred embodiment of the invention is depicted and is broadly designated by reference numeral 20. The press 20 includes a press frame 22 formed as an open rectangular frame having four vertical corner column members 24 affixed to a plate-shaped floor 26 and extending upwardly therefrom, a plurality of horizontal brace members 28 extending in a side-to-side direction of the press and rigidly connected between front and back pairs of the vertical column members 24, and a pair of side rail members 30 rigidly connected between upper ends of opposite side pairs of the vertical column members 24 and extending in a front-to-back direction of the press. The frame also includes a pair of opposite side shields 32 advantageously formed of sheet metal and attached to the opposite side pairs of the vertical column members 24 for providing a barrier between the press operator and the moving parts of the hydraulic press drive, described below. In FIGS. 2–5, one of the side shields 32 has been removed so that the hydraulic press drive can be seen. The frame 22 further includes a catch bin 34 affixed at the front side of the press for catching a finished workpiece discharged from the press, as further described below. Four caster wheels 36 are affixed to the lower end of the frame 22 so that the press can be easily transported from one place to another.

Figure 3:
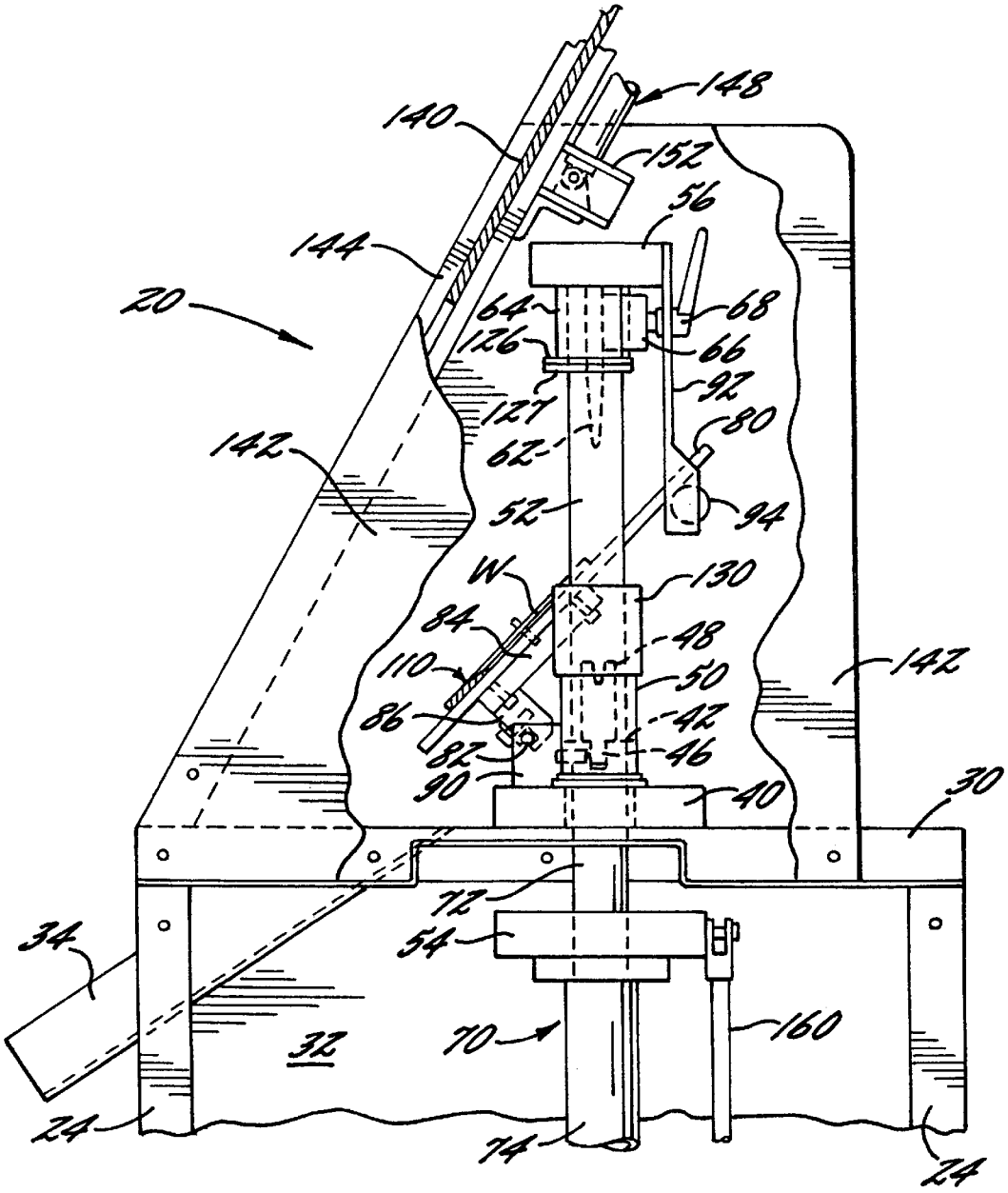
FIG. 3 is an enlargement of a portion of FIG. 2 showing the press tooling in greater detail.
Figure 5:
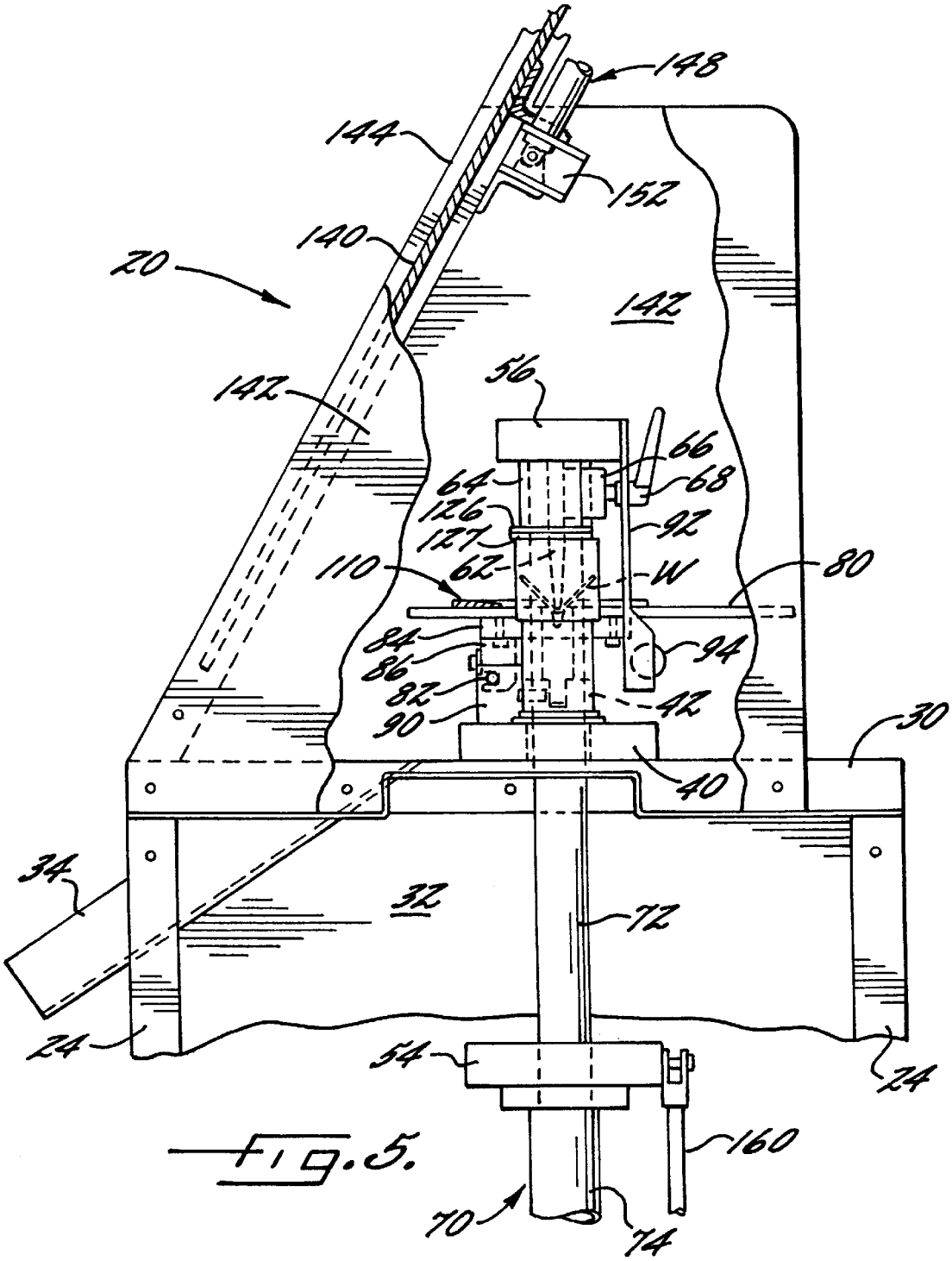
FIG. 5 is an enlargement of a portion of FIG. 4 showing the press tooling in greater detail.
Figure 8:
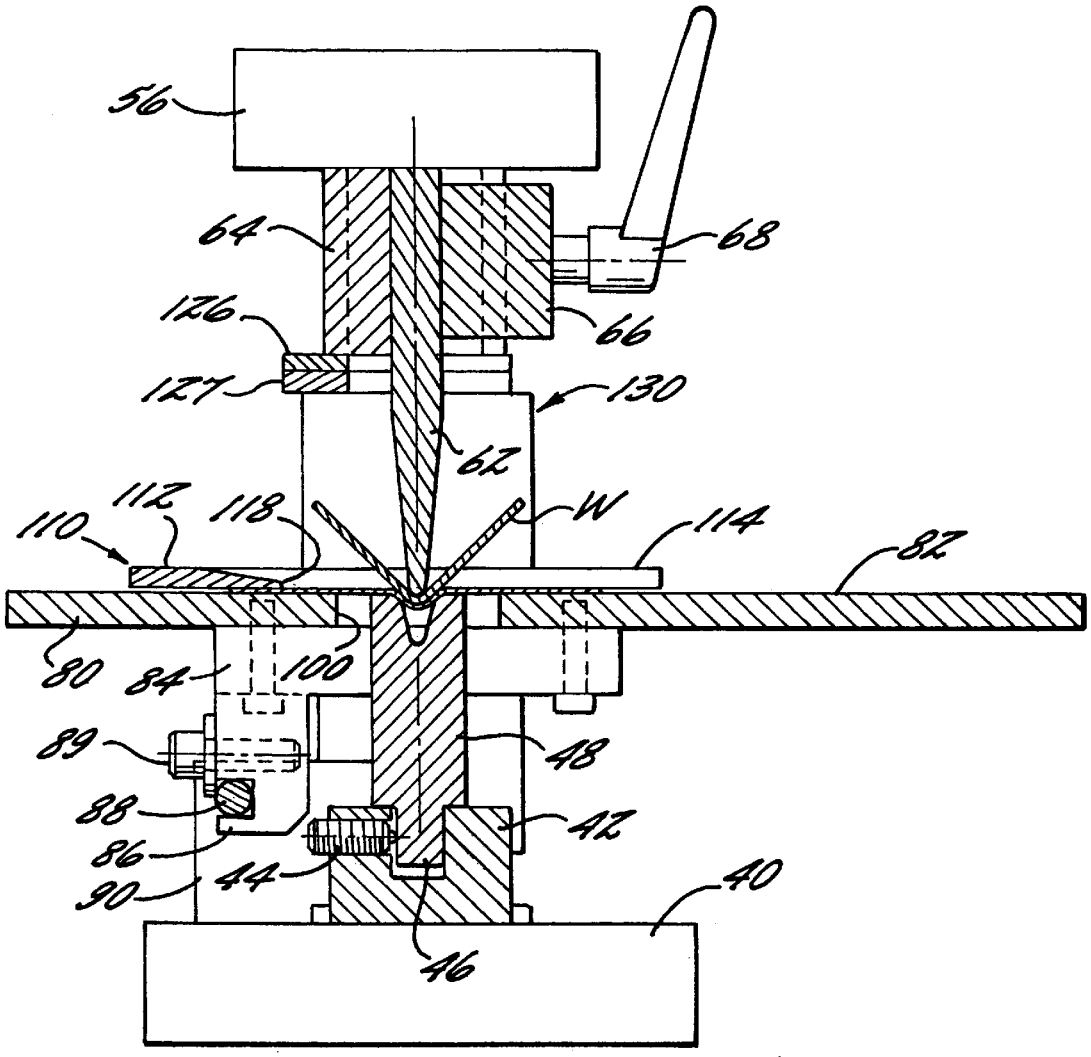
FIG. 8 is a side elevation, partly in section, of the press tooling depicting in greater detail the clamp assembly of the press for holding the upper forming tool and the lower tool holder for holding the lower forming tool.

The press 20 includes a stationary press member 40 rigidly affixed to the upper end of the frame 22 and extending in the side-to-side direction. The stationary press member 40 is formed as a thick metal plate, preferably of steel or similar high-strength material, and has a planar upper surface to which is bolted a lower die holder 42 as best seen in FIGS. 3, 5, and 8. The lower die holder 42 is formed of steel or the like and has a channel of rectangular cross-section formed in its upper surface and extending in the side-to-side direction of the press. A pair of laterally spaced spring-loaded plungers 44 (FIG. 8) extend from a front surface of the lower die holder 42 horizontally through the lower die holder in a rearward direction and into the channel. The channel receives a tongue 46 of a lower forming die 48. The tongue 46 has a thickness in the front-to-back press direction that is slightly smaller than the width of the channel in the lower die holder 42 so that there is a small amount of play therebetween. The spring-loaded plungers 44 urge the tongue 46 of the lower forming die against the forward-facing surface of the channel in the lower die holder; this forward-facing surface forms a datum surface for properly locating the lower forming die 48 in the front-to-back direction of the press.

Figure 7A:
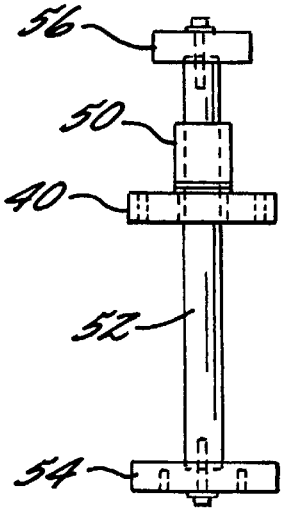
FIG. 7A is a side elevation of a die set assembly of the press.
Figure 7B:
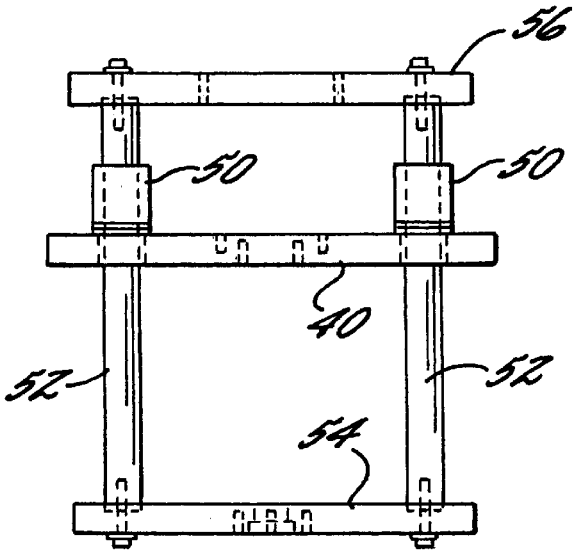
FIG. 7B is a front elevation of the die set assembly.

FIGS. 7A and 7B depict side and front elevations of a die set assembly of the press 20 that includes the stationary press member 40. The stationary press member 40 has two apertures extending through its thickness and laterally spaced apart on opposite sides of a front-to-back centerline of the press. In the apertures are mounted a pair of guide bushings 50, and a cylindrical die post 52 extends through each guide bushing 50 along a vertical direction normal to the planar upper surface of the stationary press member 40. The die posts 52 have upper ends disposed above the stationary press member 40 and lower ends disposed below the stationary press member. The lower end of each die post 52 is affixed to a lower plate 54 oriented parallel to the stationary press member 40 and spaced therebelow, and the upper end of each die post 52 is affixed to a reciprocating press member 56 formed as a thick metal plate, preferably of steel or the like, and oriented parallel to the stationary press member and spaced thereabove. The reciprocating press member 56, die posts 52, and lower plate 54 are slidable as a unit upward and downward relative to the stationary press member 40. The guide bushings 50 preferably are bronze-plated and have relatively long shoulders for precisely guiding the upward and downward movement of the reciprocating press member 56.

As best seen in FIG. 8, the clamp assembly includes a clamp base 64 that is rigidly bolted to the reciprocating press member 56, and a clamp bar 66 that is movably coupled to the clamp base 64. The clamp base 64 has close-tolerance holes through which the die posts 52 extend, so that the location of the clamping assembly is consistently maintained relative to the die posts. The clamp bar 66 and clamp base 64 define a tool-receiving space therebetween for receiving an upper end of the upper forming tool 62. The clamp bar 66 is coupled to the clamp base 64 by a pair of laterally spaced threaded fasteners 68 that pass through the clamp bar 66 from a rear-facing surface thereof and extend into the clamp base 64. By tightening the fasteners 68, the clamp bar 66 is moved in a forward direction of the press toward a rear-facing surface of the clamp base 64, and the upper end of the upper forming tool 62 is thus urged against this rear-facing surface of the clamp base, which forms a datum surface for properly locating the upper forming tool in the front-to-back direction of the press.

The press 20 includes a double-acting hydraulic cylinder 70 for causing reciprocating upward and downward movement of the reciprocating press member 56 such that the upper forming tool 62 is lowered into engagement with a workpiece supported on the lower forming tool 48 to bend the workpiece and is then raised to allow the workpiece to be discharged from the press. With primary reference to FIGS. 1, 2, and 4, the hydraulic cylinder 70 is mounted below the lower plate 54 in a vertical orientation and a rod 72 of the hydraulic cylinder extends upwardly through an aperture formed through the lower plate 54. The cylinder body 74 of the hydraulic cylinder is bolted to the lower plate 54. The upper end of the rod 72 is affixed to the stationary press member 40. Thus, when the rod 72 is forcibly extended out from the cylinder body 74 by pumping pressurized hydraulic fluid into the lower end of the hydraulic cylinder 70 and evacuating fluid from the upper end of the cylinder, the lower plate 54 is moved downward away from the stationary press member 40. The die posts 52, which are affixed to the lower plate and to the reciprocating press member 56, are thereby also moved downward, and hence the reciprocating press member 56 carrying the upper forming tool 62 is moved downward to engage a workpiece. Conversely, when the rod 72 is retracted back into the cylinder body 74 by pumping hydraulic fluid into the upper end of the hydraulic cylinder and evacuating fluid from the lower end, the lower plate 54, die posts 52, and reciprocating press member 56 are moved upward.

The press includes a hydraulic pump 76 coupled to a four-way, three-position directional valve 78 having two solenoids. An A-port of the valve 78 is connected by a suitable hydraulic line (not shown) to the lower end of the hydraulic cylinder 70, and a B-port of the valve 78 is connected by a hydraulic line (not shown) to the upper end of the hydraulic cylinder 70. The valve 78 is biased to a center position blocking flow through either the A-port or B-port when both solenoids are de-energized. When the A-side solenoid is energized and the B-side solenoid is de-energized, the hydraulic pump 76 is coupled to the A-port and fluid is pumped into the lower end of the hydraulic cylinder 70, and the B-port is coupled to the return reservoir of the pump, causing the rod 72 to be extended and the reciprocating press member 56 to be lowered to the bottom of its stroke. When the B-side solenoid is de-energized and the A-side solenoid is energized, the hydraulic pump 76 is coupled to the B-port and fluid is pumped into the upper end of the hydraulic cylinder 70, and the A-port is coupled to the return reservoir of the pump, causing the rod 72 to be retracted and the reciprocating press member 56 to be raised to the top of its stroke.

Figure 8A:
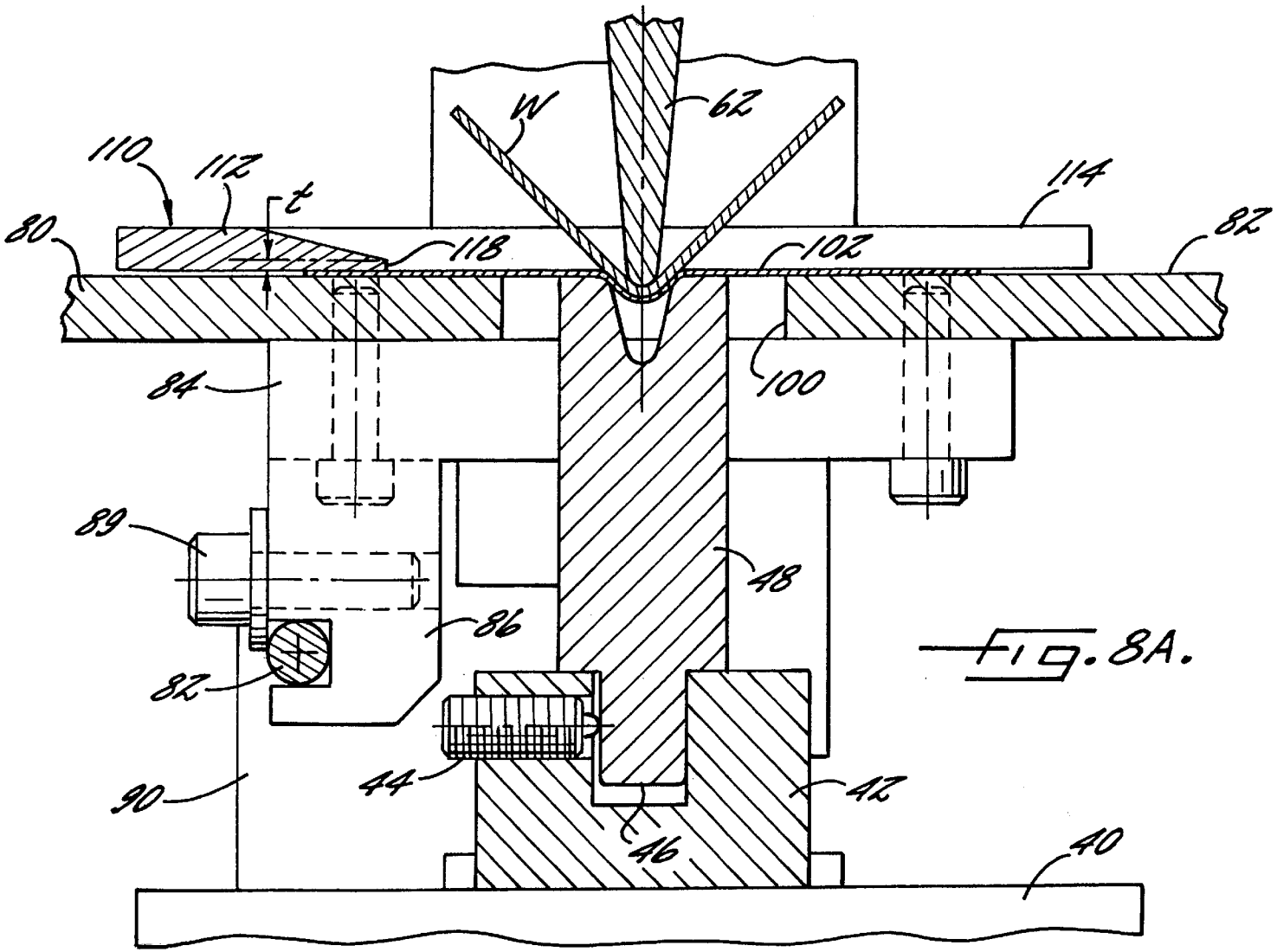
FIG. 8A is a view similar to FIG. 8 but on an enlarged scale.

The press 20 also includes a tilting table 80 (FIGS. 3, 5, and 6) for supporting and positioning a workpiece W prior to the workpiece being engaged between the upper and lower forming tools, and for automatically discharging the finished workpiece from the press after the completion of the forming operation. The tilting table 80 comprises a plate-shaped member having a generally planar upper support surface 82 on which a workpiece W is supported. The tilting table 80 includes a hinge bracket 84 affixed to its lower surface. The hinge bracket 84 includes a pair of laterally spaced arms 86 projecting downwardly from the tilting table, and each arm defines a recess for receiving a hinge pin 88 therein such that the hinge pin 88 extends horizontally in a side-to-side direction of the press. The hinge pin 88 is retained in the recesses of the hinge bracket arms 86 by a pair of bolts 89 whose heads partially cover the recesses so as to prevent the hinge pin from coming out of the recesses, as best seen in FIGS. 8 and 8A. The hinge pin 88 is rotatably supported by and extends between a pair of laterally spaced bearing blocks 90 that are rigidly affixed to the upper surface of the stationary press member 40 laterally outward of the hinge bracket arms 86. Opposite ends of the hinge pin 88 project laterally outward beyond each of the arms 86 of the hinge bracket 84 on the tilting table, and these ends of the hinge pin 88 are received through oversized bores formed through the bearing blocks 90. The oversized bores in the bearing blocks 90 enable the hinge pin 88 to freely rotate about its longitudinal axis. Thus, the tilting table 80 is able to pivot about a horizontal pivot axis defined by the longitudinal axis of the hinge pin 88.

The tilting table 80 is pivoted upward and downward as the press opens and closes by a lifting linkage 92 affixed to the reciprocating press member 56, as best seen in FIGS. 3 and 5. The lifting linkage 92 extends downward from the reciprocating press member at a location proximate to but spaced laterally outwardly of one side edge of the tilting table 80 and near a rear edge thereof. The lower end of the lifting linkage 92 rotatably supports a roller 94 that extends laterally inwardly so that the roller is disposed beneath the lower surface of the tilting table. Accordingly, the tilting table 80 rests upon the roller 94, which prevents the tilting table from pivoting downward under the influence of gravity. The length of the lifting linkage 92 is selected such that when the reciprocating press member 56 is at the top of its stroke, the tilting table 80 is held in an inclined position, advantageously at about a 45° angle relative to horizontal, as shown in FIG. 3. The lifting linkage 92 is so located in the front-to-back direction of the press relative to the tilting table 80 such that before the reciprocating press member 56 reaches the bottom of its stroke, the roller 94 disengages from the lower surface of the tilting table and continues downward as the reciprocating press member continues downward to the bottom of its stroke, as shown in FIG. 5. The tilting table 80 pivots downward as the reciprocating press member 56 moves downward, and preferably is stopped in a horizontal position by a suitable stop member (not shown) mounted on the stationary press member 40. The vertical position of the tilting table 80 when it is in the horizontal orientation is preferably such that the upper surface 82 of the tilting table is level with the upper surfaces of the lower forming tool 48, as shown in FIG. 8. To enable this to happen, the tilting table 80 includes an aperture 100 therethrough. The aperture 100 is sized and positioned relative to the lower forming tool 48 such that the lower forming tool 48 passes into the aperture 100 as the tilting table 80 approaches the horizontal position, the tilting table thus surrounding the lower forming tool. The workpiece W supported on the upper surface of the tilting table 80 is thereby lowered onto the lower forming tool 48 just prior to the upper forming tool 62 engaging the workpiece.

The tilting table 80 preferably also includes a flexible diaphragm 102 (shown in FIG. 8A, with its thickness being exaggerated for clarity) spanning the aperture 100. The diaphragm 102 advantageously is attached to the upper surface 82 of the tilting table. The diaphragm 102 can be attached to the tilting table by attaching strips of double-sided adhesive tape to the upper surface 82 on opposite sides of the aperture 100, and then pressing the diaphragm 102 onto the strips of tape. The diaphragm 102 serves two purposes. First, the diaphragm intercedes between the lower forming tool 48 and the workpiece W, and thereby prevents the lower forming tool from making scuff marks or the like on the workpiece. Second, the diaphragm 102 prevents the finished workpiece from becoming lodged in or falling through the aperture 100, and thereby assists in the automatic discharging of the finished workpiece from the press following a forming operation, as further described below. The diaphragm can be formed of any suitable flexible material. A 0.015-inch thick sheet of polyurethane has been found to be suitable for accomplishing the purposes of the diaphragm 102.

Figure 6A:
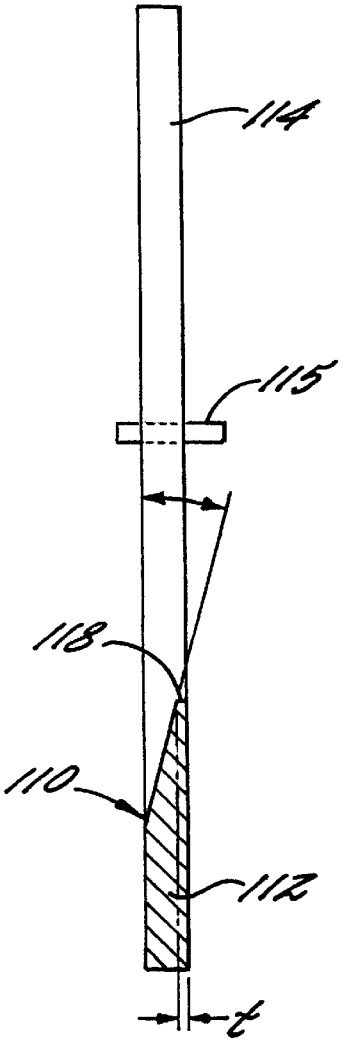
FIG. 6A is a cross-sectional view of the fixture jig.
Figure 6:
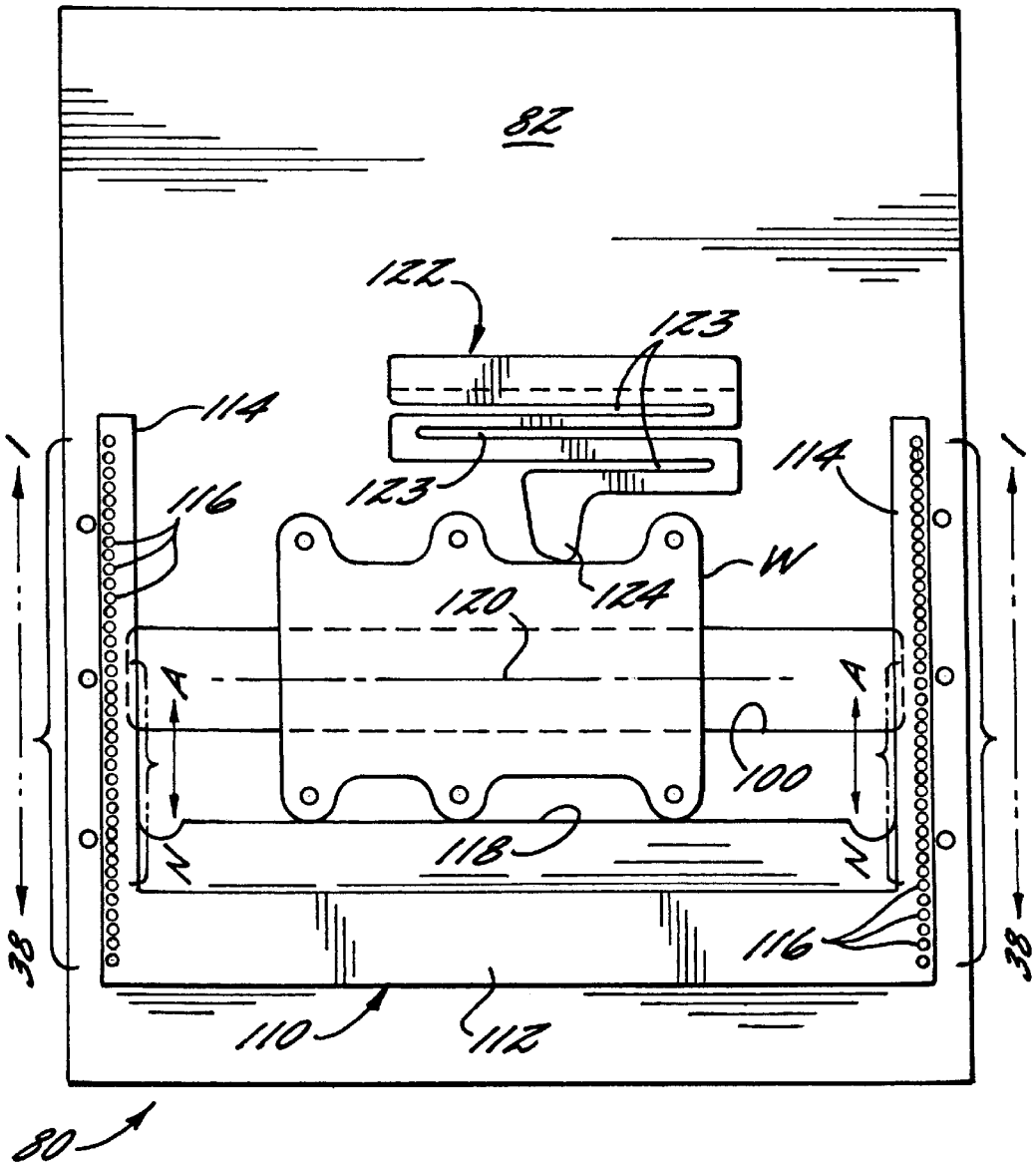
FIG. 6 is a plan view of the tilting table with the fixture jig mounted thereon, and also showing a spring device for urging the workpiece against the fixture jig.
Figure 6B:
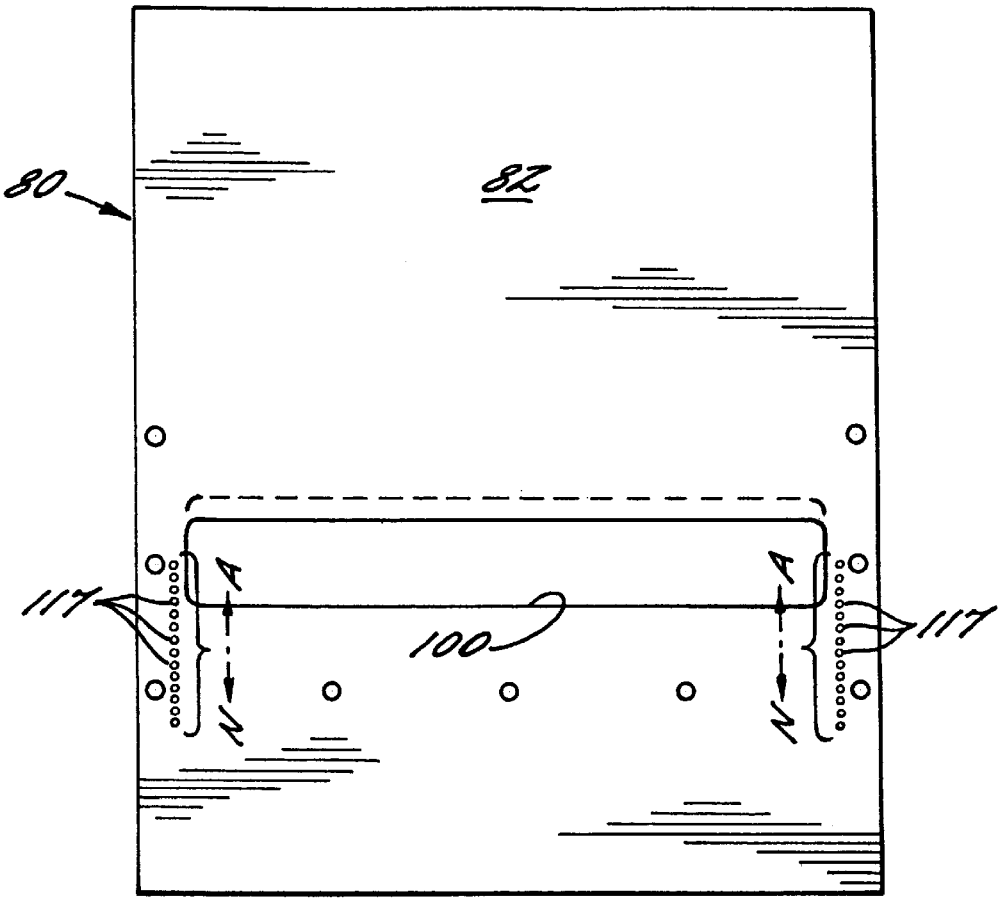
FIG. 6B is a plan view of the tilting table in isolation.

In order to properly position the workpiece W relative to the forming tools, the press preferably includes a fixture jig 110 that is releasably attached to the upper surface of the tilting table 80. The fixture jig 110 is shown attached to the tilting table in plan view in FIG. 6, and in sectioned side elevation in FIG. 6A. The fixture jig 110 comprises a wide U-shaped structure having a laterally extending stop member 112 and a pair of arms 114 affixed to opposite ends of the stop member 112 and projecting perpendicularly therefrom. The stop member 112 and arms 114 are generally flat plate-shaped structures, as shown in FIG. 6A. Through the thickness of each arm 114, a plurality of regularly spaced-apart holes 116 are formed in a straight row (labeled "1" through "38" in FIG. 6) such that each hole in one arm is aligned in the lateral direction with the corresponding hole in the other arm. The tilting table 80 also has a row of holes 117 (labeled "A" through "N" in FIG. 6B) on each of the opposite ends of the aperture 100. The row of holes 117 on one end of the aperture 100 is laterally spaced from the row on the opposite end of the aperture, in terms of center-to-center distance between the holes 117, by the same spacing that exists between the holes 116 in one arm 114 of the fixture jig 110 and the holes 116 in the other arm of the fixture jig. The center-to-center spacing between adjacent holes 116 in each row along the fixture jig arm is a small amount less than the center-to-center spacing between adjacent holes 117 in the rows of holes in the tilting table 80. For example, the fixture jig 110 advantageously has 38 holes 116 spaced 0.140 inch apart on center, while the tilting table 80 has 14 holes 117 spaced 0.150 inch apart on center. Thus, by aligning various combinations of fixture jig holes 116 with holes 117 in the tilting table and inserting pins or fasteners 115 (FIG. 6A) through the fixture jig holes into the aligned tilting table holes, the spacing between a top edge 118 of the stop member 112 of the fixture jig and the bend centerline 120 defined by the lower forming tool 48 can be varied from 0.5 inch to 3.99 inch in increments of 0.01 inch. The system of holes 116 in the fixture jig and holes 117 in the tilting table and the pins 115 that are inserted into the aligned holes collectively comprise a quick-release fastening system for the fixture jig. The workpiece W can be placed atop the tilting table 80 with one edge of the workpiece abutting the top edge 118 of the fixture jig stop member, as shown in FIG. 6, and the positioning of the fixture jig 110 along the tilting table will determine where on the workpiece the bend will be produced. By varying the position of the fixture jig 110, many different configurations of workpieces having different dimensions and bend locations can be accommodated.

The tilting table 80 thus positions the workpiece relative to the press tooling. When the reciprocating press member 56 is at the top of its stroke as shown in FIG. 3, the workpiece is urged by gravity down along the inclined surface 82 of the tilting table and against the top edge 118 of the stop member 112. Gravity tends to ensure that the workpiece remains abutted against the top edge 118 as the tilting table is pivoted downward to the horizontal position. However, if it is desired to further ensure that the workpiece remains against the top edge 118, a spring device 122 can be provided for attachment to the upper surface 82 of the tilting table. The spring device 122 engages the edge of the workpiece W on the opposite side thereof from the edge that abuts the top edge 118 of the stop member 112, and continuously urges the workpiece toward the stop member by exerting a spring force on the workpiece. In the embodiment shown in FIG. 6, the spring device comprises a flat metal plate or sheet in which a plurality of long narrow cutouts 123 are formed parallel to and spaced from each other. A finger 124 is formed at one edge of the spring device for engaging the edge of the workpiece W. A strip magnet (not shown) is secured to the lower surface of the spring device 122 for securing the spring device on the tilting table 80 when the tilting table is made of a magnetic material such as steel.

As noted above, the tilting table 80, in addition to positioning the workpiece relative to the tooling, also serves to automatically discharge the finished workpiece from the press after a forming operation has been completed. FIG. 8 shows the press at the moment when the upper forming tool 62 is carried downward by the reciprocating press member 56 to engage and bend the workpiece W against the lower forming tool 48. The workpiece W, which started out as a flat member, now has a non-flat configuration, such that the workpiece no longer abuts the top edge 118 of the stop member 112. When the reciprocating press member 56 is returned toward the top of its stroke by the hydraulic cylinder 70, the lifting linkage 92 and roller 94 lift the tilting table 80 such that it pivots upward about the pivot axis defined by the hinge pin 88, and assumes an inclined position as shown in FIG. 3. Because the stop member 112 no longer engages the workpiece W, gravity causes the workpiece to slide or tumble downward along the inclined tilting table and fall off the front edge thereof into the catch bin 34. As best seen in FIG. 8A, the stop member 112 advantageously tapers in thickness from its full thickness to a substantially smaller thickness t at the top edge 118 that engages the workpiece in its flat condition, so that there is little probability that the workpiece will become stuck on the stop member and be prevented from falling off the tilting table into the catch bin. Furthermore, as previously noted, the diaphragm 102 prevents the workpiece from falling into or becoming lodged in the aperture 100 in the tilting table, and thereby facilitates the discharging of the workpiece from the press.

Figure 9:
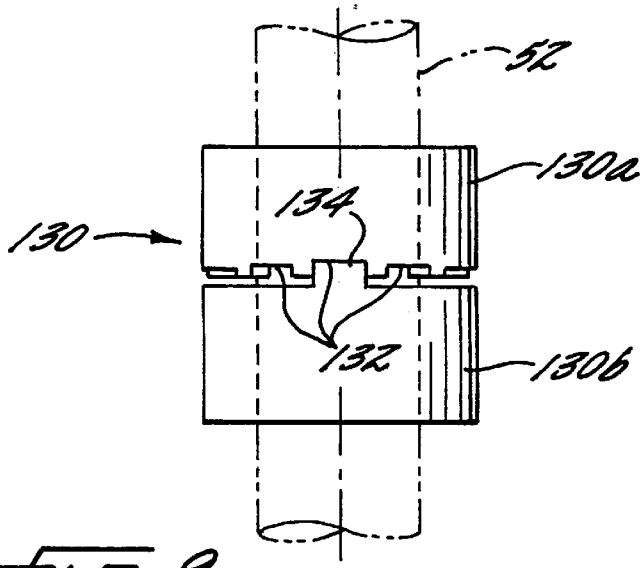
FIG. 9 is a side elevation of a spacer collar for varying the stroke of the press.

The press also includes features for controlling the stroke distance of the reciprocating press member 56. It is important to accurately control the stroke distance because in some cases a difference in stroke of as little as 0.002 inch can result in a 1° difference in the bend angle of the workpiece. Accordingly, the press includes stroke-adjusting shims 126, 127 that abut against the lower surface of the reciprocating press member 56 and are retained in place by a pair of L-shaped brackets 128 fixed at opposite ends of the reciprocating press member. The shims 126, 127 partially surround the die posts 52. On the die posts 52 are mounted a pair of variable-length spacer collars 130 above the guide bushings 50. The spacer collars 130 can freely slide and rotate relative to the die posts 52. As best seen in FIG. 9, each spacer collar 130 includes an upper half 130*a* and a lower half 130*b* that are rotatable relative to each other. In the illustrated embodiment of a collar shown in FIG. 9, the bottom face of the upper half 130*a* is machined to form a plurality of steps 132 of varying height distributed about the circumference of the upper half, and the top face of the lower half 130*b* is machined to form shoulders 134 that are able to seat against each of the steps. By rotating the upper half 130*a* relative to the lower half 130*b*, the length of the collar 130 can be varied in a number of increments. For example, six steps can be formed on the upper half of the collar in 0.0015 inch increments, whereby the collar 130 can assume six different lengths. As an alternative to the collar design shown in FIG. 9, the upper and lower collar halves could instead be connected to each other by cooperating threaded portions, such that the length of the collar would be adjusted by turning one portion relative to the other. Other suitable variable-length collar designs can also be readily envisioned by those of ordinary skill in the art. The variable-length spacer collars 130 are useful for compensating for small variations in workpiece thickness from nominal.

The bottom of the stroke of the reciprocating press member 56 is defined by the shims 126, 127 bottoming out against the top ends of the spacer collars 130, as best seen in FIG. 8. Accordingly, the stroke of the press can be adjusted by substituting shims 126, 127 of different thickness and/or by adjusting the length of the spacer collars 130. Advantageously, a plurality of shims 126 of different thicknesses are used for different predefined workpiece thickness and bend angle combinations. For example, one thickness of shim 126 may correspond to a nominal workpiece thickness of 0.063 inch and a 90° bend angle; another thickness of shim 126 may correspond to a workpiece thickness of 0.040 inch and a bend angle of 71° and so forth. A plurality of shims 127 of different thicknesses are then used for effecting incremental changes in the bend angle from nominal. For example, a 0.150-inch thick shim 127 may correspond to a 0° change in the nominal bend angle; a 0.152-inch thick shim 127 may be substituted in order to produce a negative 1° change from the nominal bend angle; a 0.154-inch thick shim may be substituted to produce a negative 2° change from the nominal bend angle; and so forth. Shims thinner than the nominal can be substituted for producing positive changes in the bend angle from nominal.

The press 20 also includes a safety shield system for preventing access to the moving press tooling during a press cycle. The safety shield system is described with primary reference to FIGS. 2 and 4, which respectively depict the press in an open position (i.e., reciprocating press member 56 at the top of its stroke) and closed position (i.e., reciprocating press member 56 at the bottom of its stroke). The safety shield system includes an upwardly and downwardly slidable safety door 140 that can be moved downwardly into a position in front of the reciprocating press member and press tooling 48, 62 so as to block the operator's access to the moving parts and tooling. Access to the tooling laterally through the press frame is prevented by a pair of stationary metal side shields 142 (partially broken away in FIGS. 2 and 4 to show the press tooling) mounted at the upper end of the press frame 22. The safety door 140 is guided in its movement by a pair of door guides 144 affixed to and projecting upwardly from the press frame 22. The door guides 144 engage opposite side edge portions of the safety door 140 and define a track within which the door slides upward and downward.

Figure 2:
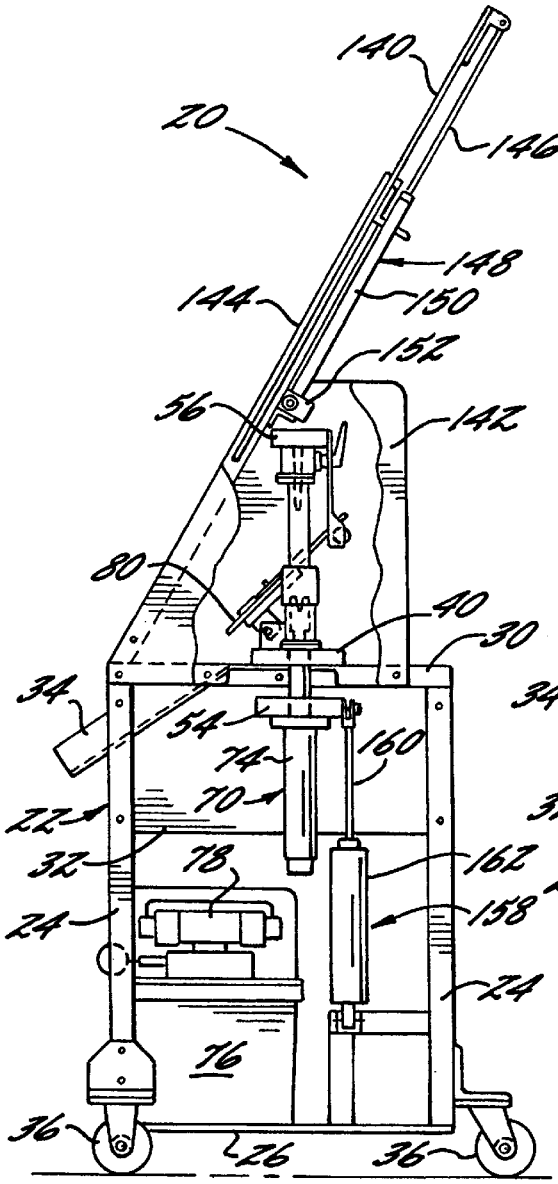
FIG. 2 is a side elevation of the press of FIG. 1, with the reciprocating press member at the top of its stroke.
Figure 4:
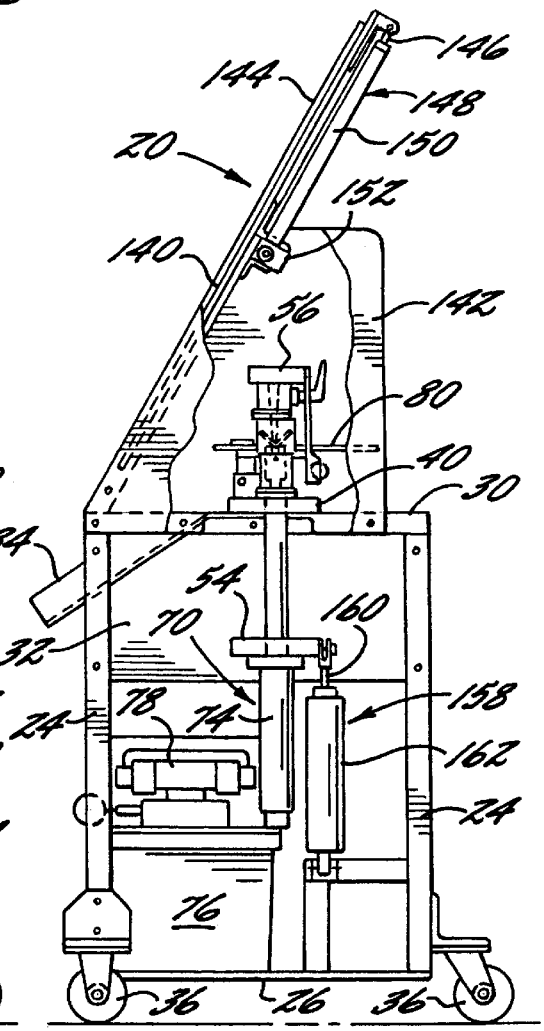
FIG. 4 is a view similar to FIG. 2, with the reciprocating press member at the bottom of its stroke.

The door 140 is moved downward automatically in response to the downward movement of the reciprocating press member 56, and is automatically moved back up again when the press opens. To this end, the safety door 140 is connected to the rod 146 of a pneumatic actuator 148. The cylinder body 150 of the actuator 148 is mounted by a bracket assembly 152 to the fixed door guides 144, and thus is stationary. Accordingly, when the rod 146 is retracted into the cylinder body 150 as shown in FIG. 4, the safety door 140 is moved downward to a closed position; when the rod 146 is extended, the door is moved upward to an open position as shown in FIG. 2.

The actuator 148 is powered by air delivered from an air supply device in the form of another pneumatic cylinder 158 of larger diameter than the actuator 148. The pneumatic cylinder 158 has its rod 160 connected to the lower plate 54 of the press die set assembly, while the cylinder body 162 is affixed to the press frame 22 such that it is stationary. When the lower plate 54 is moved downward by the press hydraulic cylinder 70, the rod 160 is forced into the cylinder body 162. The lower end of the cylinder 158 is connected by an air line (not shown) to the upper end of the pneumatic actuator 148. The lower end of the actuator 148 is connected by an air line (not shown) to the upper end of the cylinder 158, so that air can flow from the lower end of the actuator to the upper end of the cylinder. Thus, when the rod 160 is forced downwardly by the lower plate 54, air is forced out the lower end of the cylinder 158 into the upper end of the actuator 148 causing the rod 146 of the actuator to be retracted, and fluid flows out the lower end of the actuator 148 into the upper end of the cylinder 158. In this way, the safety door 140 is moved into the closed position. The actuator 148 and cylinder 158 thus form a fluid circuit. This arrangement eliminates the need for a solenoid valve and pressure regulator, and does not require a connection to an outside air source. When the press opens and the lower plate 54 moves back upward, the cylinder rod 160 is pulled out of the cylinder body 162, causing air to be forced from the upper end of the cylinder 158 into the lower end of the actuator 148, which causes the actuator rod 146 to extend and thereby open the safety door. The cylinder 158 and actuator 148 are arranged such that the actuator 148 fully closes the safety door 140 before the reciprocating press member 56 is lowered by half of its total stroke.

The safety system includes a safety interlock switch (not shown) that latches the safety door 140 in the closed position. A proximity sensor (not shown) is used to detect when the press reaches a half-closed position (i.e., the reciprocating press member has lowered by about half of its total stroke). If the safety interlock switch has not been activated by the safety door 140 by the time the proximity sensor detects the half-closed position of the press, a press controller (not shown) stops the press from moving further. Thus, the upper forming tool 62 will not enter the lower forming tool 48 if the safety door 140 is not closed. When the press is opening, the safety interlock switch is energized to unlatch the door 140. Upper and lower proximity sensors (not shown) are also used to detect when the press is in the open and closed positions. Once the upper proximity sensor indicates that the press has fully opened after a forming operation, the hydraulic pump 76 is turned off.

Operation of the press 20 proceeds as follows: The operator installs the proper lower forming tool 48 and upper forming tool 62 for the particular workpiece configuration to be processed. The shims 126, 127 corresponding to the particular workpiece configuration are installed. The fixture jig 110 is positioned in the proper location on the tilting table 80 such that the bend will be produced in the workpiece in the correct location. A workpiece is then loaded into the press by placing it on the inclined upper surface of the tilting table 80 with the lower edge of the workpiece against the upper edge 118 of the stop member 112. If needed or desired, the spring device 122 is placed on the tilting table such that it urges the workpiece against the stop member of the fixture jig. The operator next presses a cycle start button (not shown) on a front control panel (not shown), which causes the press controller (not shown) to start the hydraulic pump 76 and to energize one of the solenoids on the directional valve 78 so as to pump hydraulic fluid into the lower end of the hydraulic cylinder 70, which closes the press. As the reciprocating press member 56 moves downward, the safety door 140 closes and the tilting table 80 pivots downward until it abuts a stop member (not shown) that stops it in a horizontal position and positions the workpiece atop the lower forming tool 48. The press continues to close and the upper forming tool 62 presses the workpiece into the lower forming tool 48 to create a bend in the workpiece, as shown in FIG. 8. The downward movement of the reciprocating press member 56 is stopped by the shims 126, 127 bottoming out against the spacer collars 130; there is a pause as the hydraulic pressure in the hydraulic system builds to a maximum, and then the controller de-energizes the one solenoid of the directional valve 78 and energizes the other solenoid of the valve, which causes the hydraulic cylinder 70 to open the press. As the press opens, the safety door 140 opens and the tilting table 80 is lifted upward to the inclined position, which causes the finished workpiece to fall down along the tilting table into the catch bin 34. The hydraulic pump 76 is turned off once the press reaches a fully open position.

Many modifications and other embodiments of the invention will come to mind to one skilled in the art to which this invention pertains having the benefit of the teachings presented in the foregoing descriptions and the associated drawings. For example, although a hydraulic cylinder 70 is described for driving the press, it will be recognized that other types of actuator devices can be used instead. Furthermore, while the press 20 is described in connection with three-point bending of flat workpieces, the unique tilting table 80, safety door system, and stroke-adjusting features of the press 20 can be used in other types of reciprocating presses. Moreover, although the illustrated and described tilting table 80 starts in an inclined position prior to the beginning of a press cycle, is lowered to a horizontal position just prior to the workpiece being engaged between the press tooling, and is then raised to the inclined position as the press opens, the functions of the tilting table 80 (positioning the workpiece for a forming operation and discharging the finished workpiece after the forming operation) could be performed by a table that starts in a horizontal position surrounding the tooling, is then raised to an inclined position for discharging the finished workpiece as the press opens, and is returned to the horizontal position as the press fully opens. This may be accomplished, for example, by providing a lifting linkage (in place of the illustrated lifting linkage 92) that engages the tilting table as the press closes, and disengages the tilting table as the press approaches the fully open position such that the table then pivots back down under gravity to the horizontal position in preparation for the start of the next press cycle. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A reciprocating press for forming a workpiece, comprising:

a press frame;

a stationary press member mounted to the frame, the stationary press member being structured and arranged to support a lower forming tool;

a reciprocating press member movably supported by the frame above the stationary press member so as to be movable toward and away from the stationary press member, and a drive system for causing the reciprocating press member to execute a stroke toward and then away from the stationary press member, the reciprocating press member being structured and arranged to support an upper forming tool positioned such that the upper and lower tools engage the workpiece therebetween when the reciprocating press member is lowered to the bottom of its stroke; and a tilting table disposed between the stationary and reciprocating press members, the tilting table having a generally planar support surface structured and arranged to support the workpiece thereon, the support surface being generally horizontal when the reciprocating press member is at the bottom of its stroke, the tilting table being pivotable about a generally horizontal tilt axis and being linked to the reciprocating press member such that the tilting table is pivoted upward as the reciprocating press member returns to the top of its stroke such that the support surface becomes inclined and the finished workpiece is carried by gravity downward along the support surface and is automatically discharged from the press.

2. The press of claim 1, wherein the tilting table is generally plate-shaped and defines an aperture therethrough such that the tilting table surrounds the forming tools as the forming tools engage the workpiece.

3. The press of claim 2, further comprising a flexible diaphragm spanning the aperture in the tilting table and operable to be interposed between the lower forming tool and the workpiece, the diaphragm serving to protect the workpiece against marking by the lower forming tool and also preventing the finished workpiece from lodging in the aperture of the tilting table.

4. The press of claim 1, further comprising a lifting linkage connected to the reciprocating press member and extending downward therefrom so as to engage the tilting table for lifting one end of the tilting table when the reciprocating press member moves upward toward the top of its stroke.

5. The press of claim 4, wherein the lifting linkage includes a roller at a lower end thereof, the roller engaging a lower surface of the tilting table adjacent the one end thereof.

6. The press of claim 1, further comprising a fixture jig affixed to the tilting table and adapted to position the workpiece in a predetermined location with respect to the tilting table and the forming tools.

7. The press of claim 6, wherein the fixture jig comprises a stop member positioned on the tilting table so that the workpiece can be abutted against the stop member, the stop member being releasably affixed to the tilting table by a quick-release fastening system.

8. The press of claim 7, wherein the quick-release fastening system comprises a plurality of holes defined in the tilting table and a plurality of holes defined in the fixture jig and alignable with the holes in the tilting table, and fasteners inserted through selected ones of the holes in the fixture jig and into selected ones of the holes in the tilting table.

9. The press of claim 7, further comprising a spring device mounted on the tilting table adjacent the support surface thereof and operable to apply a spring force to the workpiece urging the workpiece against the stop member of the fixture jig.

10. The press of claim 1, wherein the stationary press member comprises a plate defining a pair of apertures extending vertically therethrough, the reciprocating press member having a pair of die posts affixed thereto and extending downward through the apertures in the stationary press member, the die posts serving to guide the reciprocating press member as it moves upward and downward.

11. The press of claim 10, further comprising a variable-length collar slidably and rotatably mounted on each of the die posts between the stationary and reciprocating press members, the variable-length collars forming a stop for the reciprocating press member preventing further downward movement thereof when the press closes and the reciprocating press member abuts the collars, an axial length of each collar being selectively adjustable for adjusting a stroke distance of the reciprocating press member.

12. The press of claim 11, wherein the reciprocating press member includes an upper plate affixed to the die posts and at least one shim secured to the upper plate and positioned to abut the collars when the press closes.

13. The press of claim 12, wherein the lower forming tool comprises a die and the upper forming tool comprises a punch configured to press the workpiece into the die to bend the workpiece through a predetermined bend angle, and wherein the reciprocating press member includes a pair of shims stacked one atop the other, a first one of the shims being selected to correspond to a particular workpiece configuration to be produced, and a second one of the shims being selected to produce a predetermined deviation in the bend angle.

14. The press of claim 10, wherein the drive system includes a hydraulic cylinder disposed below the stationary press member and coupled with the die posts, the hydraulic cylinder being operable to drive the die posts upward and downward so as to drive the reciprocating press member.

15. The press of claim 14, wherein lower ends of the die posts are disposed below the stationary press member, and further comprising a lower plate affixed to the lower ends of the die posts, one of a rod and a cylinder body of the hydraulic cylinder being affixed to the lower plate, the other of the rod and cylinder body being affixed to stationary structure of the press, whereby extension and retraction of the rod within the cylinder body cause the reciprocating press member to be driven.

16. The press of claim 15, wherein the cylinder body of the hydraulic cylinder is vertically disposed below the lower plate and is affixed thereto, the rod extending through the lower plate and being affixed to the stationary press member, whereby extension of the rod from the cylinder body causes the cylinder body to be driven downward so as to drive the reciprocating press member downward.

17. The press of claim 1, further comprising a safety door movable between an open position allowing operator access to the tilting table and a closed position preventing said access.

18. The press of claim 17, further comprising an actuator system for automatically moving the safety door to the closed position prior to the press closing.

19. The press of claim 18, wherein the actuator system includes a fluid supply device linked to the reciprocating press member such that downward movement of the reciprocating press member forces fluid under pressure from the fluid supply device, and a fluid-powered actuator connected to the safety door and fluidly coupled to the fluid supply device such that the fluid forced from the fluid supply device activates the actuator to close the safety door.

20. The press of claim 19, wherein the fluid supply device and actuator comprise pneumatic cylinders and are connected together in a fluid circuit such that air is forced from one end of the fluid supply device into one end of the actuator to cause the actuator to close the safety door during downward movement of the reciprocating press member, air being forced from an opposite end of the fluid supply device into an opposite end of the actuator during upward movement of the reciprocating press member to cause the actuator to open the safety door.

* * * * *